US005836113A

United States Patent [19]

Bachman

[11] Patent Number: 5,836,113

[45] Date of Patent: Nov. 17, 1998

[54] SYSTEM AND METHOD OF SECURING AND FINISHING EXTERIOR SIDING PANELS

[75] Inventor: Douglass Bachman, 1305 Thunderbrook Dr., Desoto, Tex. 75115

[73] Assignees: Douglass Bachman, Desoto; Lynn Nickols, Grand Prairie, both of Tex.

[21] Appl. No.: 884,182

[22] Filed: Jun. 27, 1997

Related U.S. Application Data

[63] Continuation-in-part of Ser. No. 846,138, Apr. 25, 1997.

[51] Int. Cl.[6] ..... E04B 7/00

[52] U.S. Cl. ..... 52/94; 52/287.1; 52/288.1

[58] Field of Search ..... 52/28, 94, 272, 52/279, 287.1, 288.1

[56] References Cited

U.S. PATENT DOCUMENTS

| | | | |
|---|---|---|---|
| 3,181,275 | 5/1965 | Schroter et al. | 52/64 X |
| 3,735,538 | 5/1973 | Ramins | 52/94 |
| 4,189,885 | 2/1980 | Fritz . | |
| 4,339,898 | 7/1982 | Pichette | 52/94 |
| 4,411,120 | 10/1983 | Ellis et al. | 52/287.1 X |
| 4,461,128 | 7/1984 | Knoebl | 52/94 |
| 5,377,463 | 1/1995 | Howe | 52/94 X |
| 5,392,579 | 2/1995 | Champagne . | |
| 5,537,791 | 7/1996 | Champagne . | |
| 5,560,170 | 10/1996 | Ganser et al. . | |
| 5,657,585 | 8/1997 | Zaccagni | 52/94 |

*Primary Examiner*—Christopher Kent
*Assistant Examiner*—Timothy B. Kang
*Attorney, Agent, or Firm*—Steven W. Smith

[57] ABSTRACT

A system and method of securing and finishing exterior siding panels. The system includes a bracket mounted on an adjacent surface, a snap-in trim piece, and a siding panel covering a wall. The snap-in trim piece includes an extender having a plurality of crimps for interlocking with a hook at the end of the bracket. Additionally, the snap-in trim piece includes, at another end, a snap-in trim fastener for contacting the siding panel to the wall. Wires or cables may be run through a gap between the snap-in trim piece and a corner where the bracket and the siding panel meet. Additionally, the snap-in trim piece may also act as a trim sectional with coordinating colors to match and accentuate the beauty of the siding panels.

19 Claims, 9 Drawing Sheets

SYSTEM AND METHOD OF SECURING AND FINISHING EXTERIOR SIDING PANELS

CROSS REFERENCE TO RELATED APPLICATION

This application is a continuation-in-part of U.S. patent application Ser. No. 08/846,138 titled "Top Panel Snap-in Trim For Exterior Siding," filed Apr. 25, 1997 and hereby incorporated by reference as if quoted in its entirety herein.

BACKGROUND OF THE INVENTION

1. Technical Field of the Invention

This invention relates to exterior wall siding and, more particularly, to a system and method of securing and finishing exterior siding panels to buildings which creates a channel to hide telephone, cable TV and satellite dish wiring.

2. Description of Related Art

The use of exterior siding panels for buildings has become increasingly popular over the years. The siding may be constructed of various types of vinyl or aluminum. Regardless of the type, trim and accessory components are necessary to install the siding and finish it off. These trim components typically comprise inside corners, outside corners, J-channels, drip caps, L-channels, finish trim and various other trim moldings.

The fitting and installing of siding and trim components can be difficult and time-consuming. Of particular concern, is the cutting of siding to fit into a mounting bracket, typically called a J-channel. If the top panel, the final panel going into a J-channel is off by more than approximately a quarter of an inch, the siding will not properly sit in the J-channel. The same situation arises for a flat wall top out panel or a gable top out panel. Additionally, since there is a small tolerance for error on fitting this panel into the J-channel, there is a tendency for the panel to shift over time and pop out of the J-channel, due to the passage of time and exposure to the weather elements. In addition, many times the siding is placed on the bottom of eaves, gables, or overhangs. The siding panels on these overhangs, called soffit panels, also require J-channel brackets to secure the soffit panels in place.

Although there are no known prior art teachings of a solution to the aforementioned deficiency and shortcoming such as that disclosed herein, prior art references that discuss subject matter that bears some relation to matters discussed herein are U.S. Pat. No. 4,189,885 to Fritz (Fritz), U.S. Pat. No. 5,392,579 to Champagne (Champagne I), U.S. Pat. No. 5,537,791 to Champagne (Champagne II), and U.S. Pat. No. 5,560,170 to Ganser et al. (Ganser).

Fritz discloses various trim components for siding construction. The principal component is a trim strip having a J-shaped channel and a smaller adjacent C-shaped channel opening perpendicular to each other. Fritz merely discloses a well known J-channel for securing siding. Fritz does not teach or suggest a method for using snap-in trim in conjunction with a J-channel for securing and finishing siding.

Champagne I discloses a clip of strip metal which engages with an uppermost panel of a building siding and a top out panel to secure the top out panel in position between the uppermost panel and the soffit. Champagne I uses a J-channel to secure the uppermost panel. Champagne I does not teach or suggest using snap-in trim in conjunction with a J-channel for a soffit panel to secure and finish the uppermost panel of an adjacent wall.

Champagne II discloses a mounting clip for siding. The clip is placed on the top edge of a top panel before inserting the top edge into a trim strip such as a J-channel. The clip is used to position the top panel in a trim strip having a relatively wide groove. The clip snaps into the J-channel, and is equipped with barbs which ensures the top panel is held securely in the J-channel. Champagne II still requires that the top panel be cut to the exacting tolerances required for use with a J-channel. It also requires separate J-channels for the wall and the adjacent soffit panel. Champagne II does not teach or suggest snap-in trim in conjunction with the a J-channel of an adjacent wall.

Ganser discloses a trim band system for use with exterior siding which eliminates the need for J-channels and provides an enhanced aesthetic appearance. However, J-channels are widely used in the siding industry, and Ganser does not teach or suggest a mounting clip which works in conjunction with the J-channel of a soffit panel to secure and finish the top panel of an adjacent wall while providing an enhanced aesthetic appearance.

Thus, it would be a distinct advantage to have a system and method of securing and finishing exterior siding panels while providing an enhanced aesthetic appearance and enabling panels to be rough cut to much less exacting tolerances than is required today. It is an object of the present invention to provide such a method and system.

SUMMARY OF THE INVENTION

In one aspect, the present invention is a system for finishing and securing an exterior siding top panel attached to a wall. The wall meets an adjacent surface at a right-angle corner at a top end of the wall. The system comprises a siding panel covering the adjacent surface and a bracket mounted on the adjacent surface at the corner for holding an end of the siding panel covering the adjacent surface. The bracket has a clip with a hook at the clip's end. Additionally, the system includes a snap-in trim piece for holding a top end of the siding panel. The snap-in trim piece includes a plurality of crimps running along a top surface of the snap-in trim piece. The system also includes means for interlocking the bracket and the snap-in trim piece to assist in finishing and securing the siding panel to the wall. The means for interlocking is formed by inserting the plurality of crimps between the siding panel, the adjacent surface and the hook in the clip.

In another aspect, the present invention is a system for providing finishing trim for exterior siding panels on a wall. The wall meets an adjacent surface at a right-angle corner. The system comprises a siding panel covering the adjacent surface and a J-channel bracket mounted on the adjacent surface at the corner for holding an end of the siding panel covering the adjacent surface. The J-channel bracket includes a J-channel clip having a hook at its end. The system also includes a piece of snap-in trim for covering an end of the exterior siding panels. The snap-in trim piece has a snap-in trim extender for inserting in the J-channel in which at least one crimp forms a ridge on a bottom surface of the snap-in trim extender. The crimp interlocks with the hook at the end of the J-channel clip when the snap-in trim extender is inserted in the J-channel bracket.

In still another aspect, the present invention is a method of finishing and securing an exterior siding panel to a wall. The wall meets an adjacent surface at a right-angle corner. The method includes the steps of covering the adjacent surface with a siding panel and mounting a J-channel bracket on the adjacent surface at the corner. The J-channel bracket holds an end of the siding panel covering the adjacent surface. The siding panel is then attached to the wall. Next, a snap-in trim piece having an extender on an end thereof with a crimp forming a ridge on a surface of the snap-in trim piece interlocks with the J-channel hook. Then the siding panel at the lower end of the snap-in trim piece contacts the siding panel to the wall.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

The present invention is a system and method for assisting in finishing and securing the top panel of exterior siding.

Figure 1:
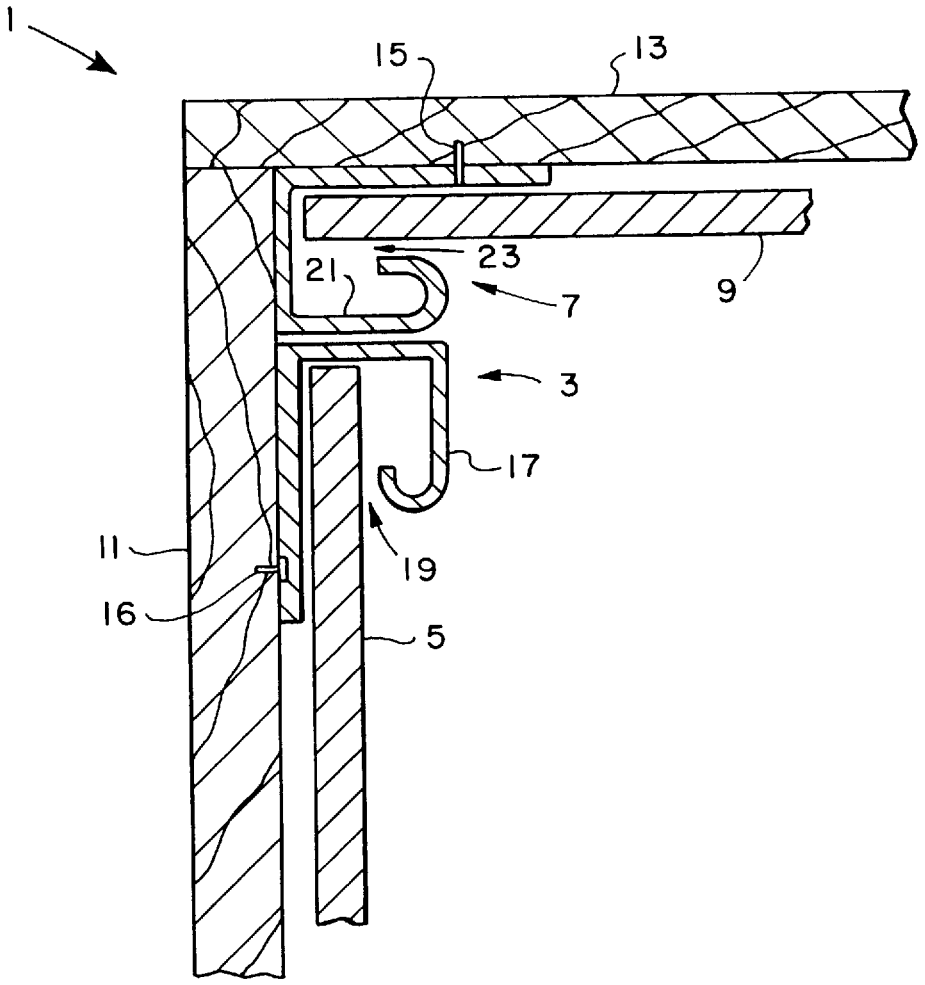
FIG. 1 PRIOR ART
FIG. 1 (prior art) is a sectional view illustrating the existing siding system for securing a top panel, and an adjacent soffit panel, utilizing separate J-channel brackets.

FIG. 1 is a sectional view illustrating the existing siding system for securing a top panel, and an adjacent soffit panel, utilizing separate J-channel brackets. The existing siding system 1 includes a top panel J-channel bracket 3, a top panel 5, a soffit panel J-channel bracket 7, a soffit panel 9, a side wall 11, a soffit 13, a nail 15, a nail 16, a clip 17, a gap 19, a clip 21, and a gap 23.

The top panel 5 is secured to the side wall 11 by the top panel J-channel bracket 3. The J-channel bracket 3 runs for the entire length of the building where the top panel 5 is located. The top panel 5 covers the side wall 11. The top panel 5 is attached to the side wall 11 by various means. In the method depicted in FIG. 1, the top panel 5 is attached by depositing a silicone glue to the uppermost portion of the top panel 5 in order to adhere it to the J-channel bracket 3 within the gap 19. Another common method is to attach a mounting clip to the J-channel bracket 3, such as described in Champagne II, which positions the top panel 5 in the gap 19. The top panel J-channel bracket 3 is secured by the nail 16 to the side wall 11.

The soffit panel 9 is secured into the soffit panel J-channel bracket 7. The soffit panel J-channel bracket 7 is identical to the top panel J-channel bracket 3, except it is orientated in a different direction in order to receive the soffit panel 9. The soffit panel J-channel bracket 7 is secured to the soffit by the nail 15. The soffit panel 9 is secured by inserting the soffit panel 9 in the gap 23. The soffit panel 9 is held in place by the clip 21.

There are several disadvantages to the existing system. First, the top panel J-channel bracket 3 assists in securing the top panel 5 by clip 17, which measures no more than one inch. When an installer is fitting the top panel 5, the installer must insure that the top panel 5 properly fits within the gap 19. If the installer cuts the top panel 5 too short, the top panel 5 will not extend far enough into the J-channel to secure the panel. If he cuts the top panel too high, it will not fit between the J-channel and the next panel below. The tolerance on this cut is less than half an inch. Therefore, the installer must meticulously cut the top panel 5 to properly fit in the top panel J-channel bracket 3. The process of precisely cutting the top panel 5 can be very time consuming. Additionally, since the top panel 5 is secured within the top panel J-channel bracket 3 by only about one inch of the clip 17, the top panel 5 has a tendency to work itself out of the top panel J-channel bracket 3 over the passage of time.

An additional disadvantage of the existing system is that two J-channel brackets are required, one J-channel bracket for the soffit panel and another J-channel bracket for the top panel. Therefore, more time and materials are needed to install the additional J-channel brackets.

Finally, on many occasions, cables and wires have to be hung outside of the exterior siding. Therefore, cables are exposed to the environment and detract from the aesthetic appearance of the building and the side paneling.

Figure 2:
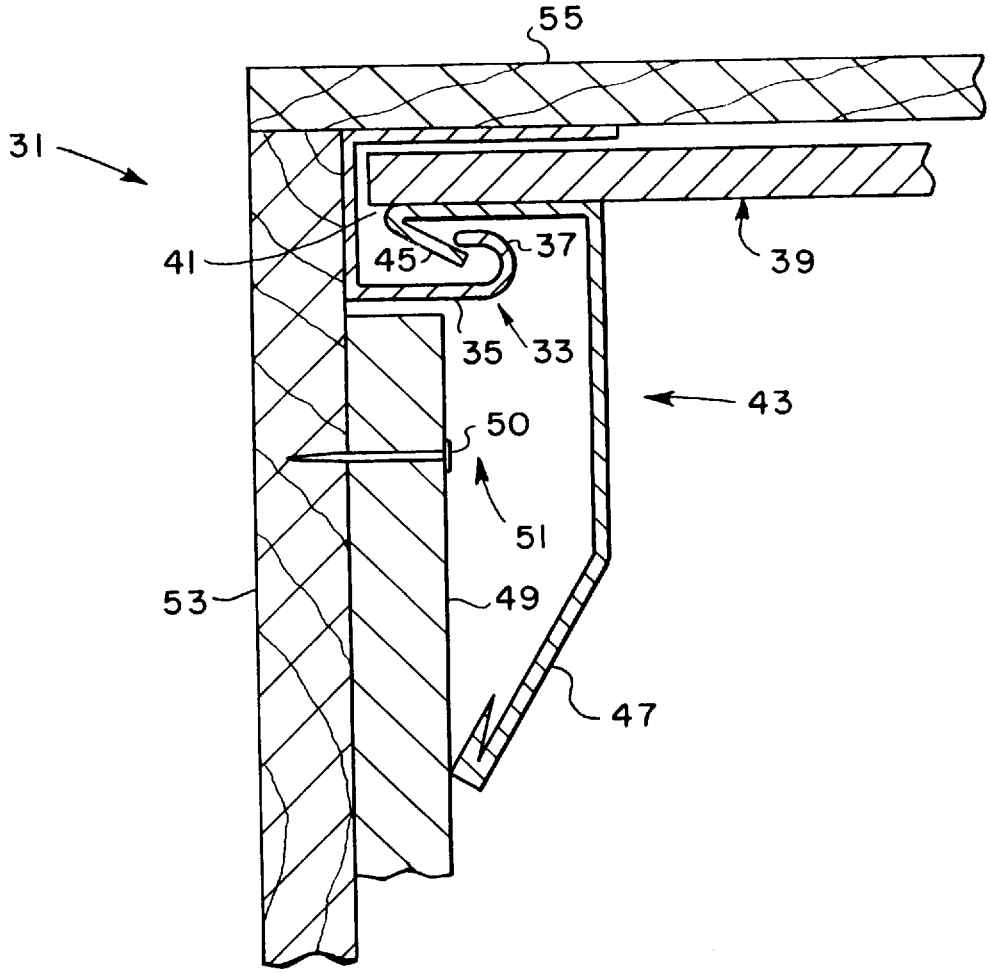
FIG. 2 is a sectional view illustrating a first embodiment of the trim finishing system of the present invention in which the top panel snap-in trim is attached to a J-channel for a soffit panel.

FIG. 2 is a sectional view illustrating a first embodiment of the trim finishing system of the present invention in which the top panel snap-in trim is attached to a J-channel for a soffit panel. The trim finishing system 31 includes a soffit panel J-channel bracket 33 having a J-channel clip 35 and a hook 37, a soffit panel 39, a J-channel gap 41, a top panel snap-in trim 43 having a top panel snap-in trim grasper 45 and a top panel snap-in trim fastener 47, a top panel 49, a nail 50, a top panel gap 51, a side wall 53, and a soffit 55.

The J-channel bracket 33 used to secure soffit panels in the system 31 is commonly used in the exterior siding industry. In the orientation depicted in FIG. 2, the J-channel bracket 33 is secured to the soffit 55 and rests against the side wall 53. The J-channel bracket 33 runs for the entire length of the house where the soffit 55 is located. The soffit panel 39 is the exterior siding used to cover the soffit 55. The soffit panel 39 is inserted into the J-channel gap 41. The soffit panel 39 is held in place within the J-channel gap 41 by the J-channel clip 35. The J-channel clip 35 is a horizontal outcropping of the J-channel bracket 33. The J-channel clip 35 extends out approximately one inch from the base of the J-channel bracket 33. The J-channel clip 35 is formed into a hook 37 at its end.

Figure 3:
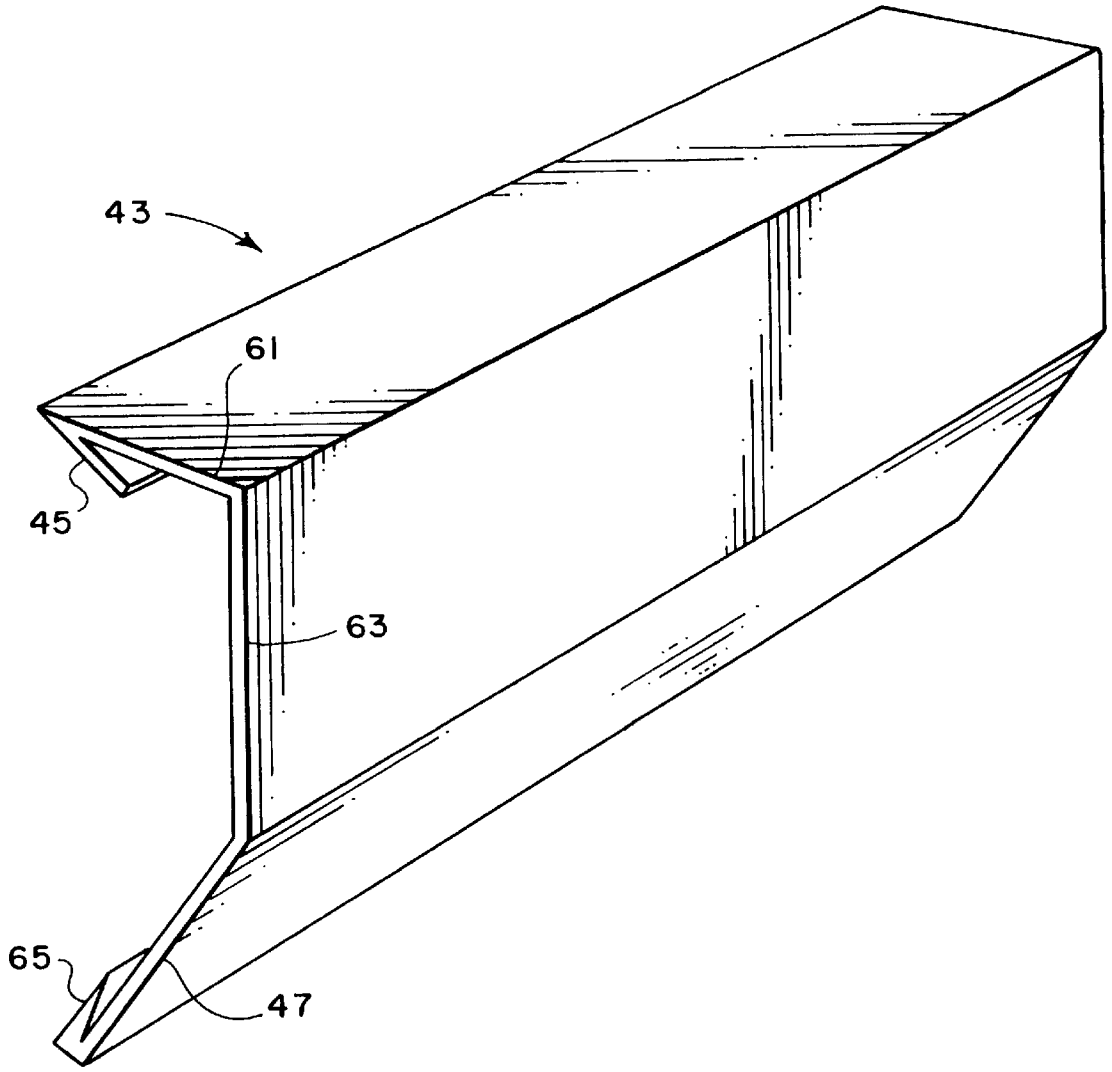
FIG. 3 is a perspective view of the top panel snap-in trim of FIG. 2.

FIG. 3 is a perspective view of the top panel snap-in trim 43 of FIG. 2. The top panel snap-in trim 43 is a snap-in trim made from almost any material used in the siding industry, such as poly-vinyl chloride (PVC) coated aluminum or vinyl. The top panel snap-in trim 43 may be constructed by bending a single sheet of, for example aluminum, into the shape shown in FIGS. 2 and 3. The top panel snap-in trim 43 includes a top panel snap-in trim grasper 45, a top panel snap-in trim fastener 47, a top panel snap-in trim extender 61, a top panel snap-in trim base 63, and a top panel snap-in trim stiffener 65. The top panel snap-in trim grasper 45 makes an acute angle with reference to the top panel snap-in trim extender 61. The top panel snap-in trim extender 61 is such a length from the top panel snap-in trim base 63 to the top panel snap-in trim grasper 45, to form the gap 51 allowing the insertion of a top panel 49 into the gap 51. The top panel snap-in trim base 63 extends perpendicularly from the top panel snap-in trim extender 61. The top panel snap-in trim base 63 bends diagonally inward toward the side wall 53 to form a top panel snap-in trim fastener 47. The length of the top panel snap-in trim base 63 and the top panel snap-in trim fastener 47 is together, normally approximately three inches long, however the length may vary with the preference of the siding installer. Longer lengths allow for rougher cuts of the top panel, but lengths over three inches may detract from the aesthetic appearance. Attached to the end of the top panel snap-in trim fastener 47 is the top panel snap-in trim stiffener 65 providing additional stiffness and reinforcement at the bottom of the top panel snap-in trim fastener 47.

With continuing reference to FIGS. 2 and 3, when the soffit panel 39 is held in place at the J-channel bracket 33, the top panel snap-in trim 43 may then be utilized. In the preferred embodiment of the invention, horizontal slots are placed along a top edge of the top panel 49. The top panel 49 is then fastened to the side wall 53 by the nail 50. After the top panel 49 is attached to the side wall 53 by nail 50, the top panel snap-in trim 43 is inserted into the gap 41. The top panel snap-in trim 43 snaps into the gap 41 allowing the interlocking of the top panel snap-in trim grasper 45 and the hook 37 at the end of the J-channel clip 35. The top panel snap-in trim 43 is held securely in place between the soffit panel 39 and the hook 37 forming a lock from which the top panel snap-in trim 43 cannot be removed from the J-channel bracket 33. The top panel 49 is held in place in the gap 51 by the top panel snap-in trim base 63 and the top panel snap-in trim fastener 47. The top panel snap-in trim fastener 47 contacts the top panel 49 at approximately three inches from the top of the top panel 49. This is well below the point to which the top panel may shift over time. Additionally, the top panel snap-in trim 43 completely hides the nail 50.

The top panel snap-in trim 43 provides many advantages over the existing system 1. By using the top panel snap-in trim 43, a J-channel bracket is completely eliminated from assisting in securing and finishing a top panel to a side wall. Since the top panel snap-in trim 43 extends down much farther than the J-channel clip 17, the exacting measurements needed in fitting top panels to a house are eliminated. With the top panel snap-in trim 43, a siding installer can "rough cut" the top panel 49 and nail the top panel 49 to the side wall 53, thereby decreasing the time necessary in installing the siding. Additionally, the top panel snap-in trim 43 is easily installed by snapping the top panel snap-in trim 43 into the J-channel 33, thus eliminating the time consuming process of nailing or fastening an additional J-channel to the side wall 53. The top panel snap-in trim 43 interconnects with additional top panel snap-in trim sections, thereby eliminated the need for nails, screws or rivets to combine sections. In addition, since the top panel snap-in trim 43 extends further down on the top panel 49, the top panel 49 is more securely attached to the side wall 53, and the top panel 49 cannot work its way below the area covered by the top panel snap-in trim 43.

The gap 51 formed between the top panel snap-in trim 43 and the top panel 49 forms a chamber through which exterior cables may be run. The cables are thus protected from the elements by the top panel snap-in trim 43 and are hidden from view. Finally, the top panel snap-in trim 43 actually enhances the beauty of the exterior siding. The unsightly and uneven appearance that can occur from placing two J-channels together is eliminated. Additionally, caulking is no longer necessary for the upper section of the top panel. Also, painting over trim nails is not necessary, since the trim nails are completely hidden by the top panel snap-in trim 43. The top panel snap-in trim 43 acts as a trim device which may be painted a coordinated color to accentuate the aesthetic appearance of the exterior siding and create a crown molding effect.

Although the top panel snap-in trim 43 has been illustrated as being attached to the J-channel bracket used to secure soffit panels, the top panel snap-in trim 43 is not limited to this embodiment. Any J-channel bracket, or any similar mounting bracket, may be used in conjunction with the top panel snap-in trim 43. For example, the top panel snap-in trim 43 may attach to a J-channel bracket securing adjacent side walls, gables, or eaves. The top panel snap-in trim 43 may be used both vertically and horizontally depending on the orientation of the J-channel bracket to which it attaches. In addition, the top panel snap-in trim 43 may be adjusted for various angles when used with J-channel brackets for angling overhangs.

Figure 4:
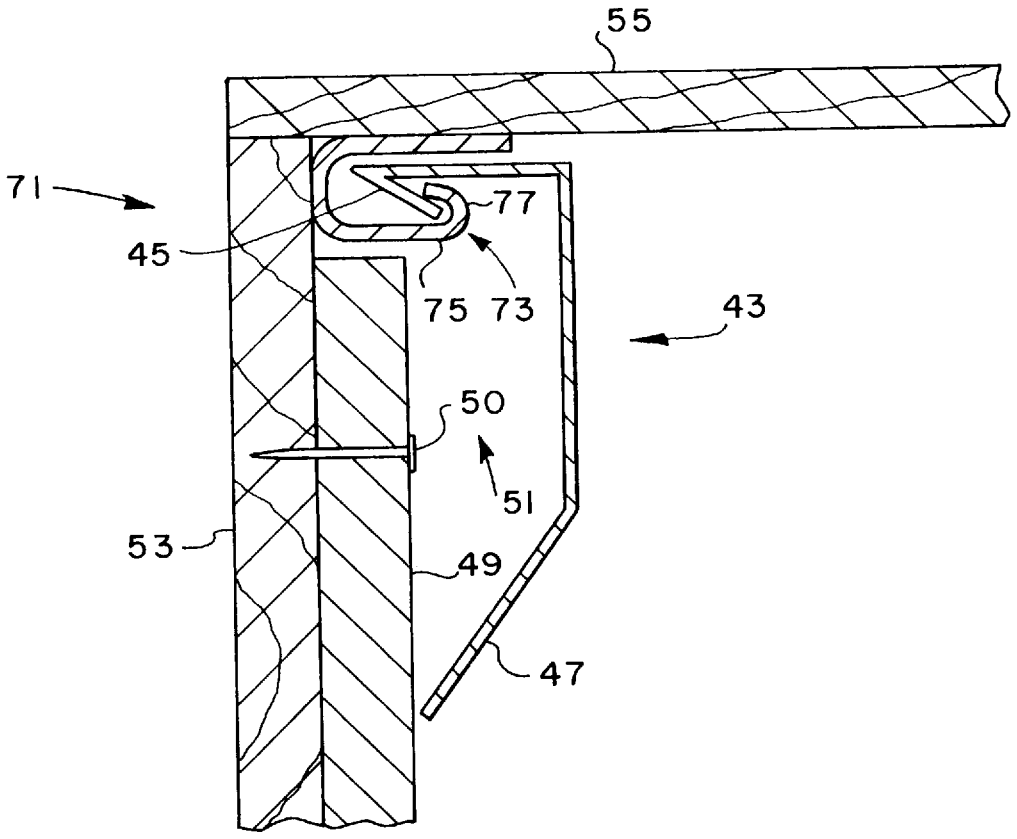
FIG. 4 is a sectional view illustrating a second embodiment of the trim finishing system of the present invention in which the top panel snap-in trim is attached to a finish trim bracket of an adjacent wall.

FIG. 4 is a sectional view illustrating a second embodiment of the trim finishing system of the present invention in which the snap-in trim is attached to a finish trim bracket of an adjacent wall. The trim finishing system 71 includes a snap-in trim 43 having a snap-in trim grasper 45 and a snap-in trim fastener 47, a top panel 49, a nail 50, a top panel gap 51, a side wall 53, a soffit 55, and a finish trim bracket 73 having a finish trim clip 75 and a finish trim hook 77.

The finish trim bracket 73 is used in areas adjacent to brick walls or voids where siding is not used on adjacent walls. Additionally, the finish trim bracket 73 may be used either horizontally or vertically. In FIG. 4, the finish trim bracket 73 is positioned where the side wall 53 and the soffit 55 meet. The finish trim clip 75 is a horizontal outcropping of the finish trim bracket 73. Since the finish trim bracket 73 is not securing a soffit panel to a soffit, the finish trim bracket 73 does not have a gap of the size needed to receive a soffit panel. However, like a J-channel bracket, the finish trim clip 75 is formed into the finish trim hook 77 at its end.

Horizontal slots may be placed along a top edge of the top panel 49 to facilitate fastening the top panel to the side wall 53. The top panel 49 is then fastened to the side wall 53 by one or more nails 50, which are placed through the horizontal slots. After the top panel 49 is attached to the side wall 53 by the nail 50, the snap-in trim 43 is inserted into the finish trim bracket 73. The snap-in trim grasper 45 interlocks into the finish trim hook 77. The snap-in trim 43 is held securely in place between the soffit 55 and the finish trim hook 77 forming a lock from which the snap-in trim cannot be removed from the finish trim bracket 73. The snap-in trim fastener 47 contacts the top panel 49 at approximately three inches from the top of the top panel 49. This is well below the point to which the top panel may shift over time. Additionally, the snap-in trim 43 completely hides the nail 50.

Figure 5A:
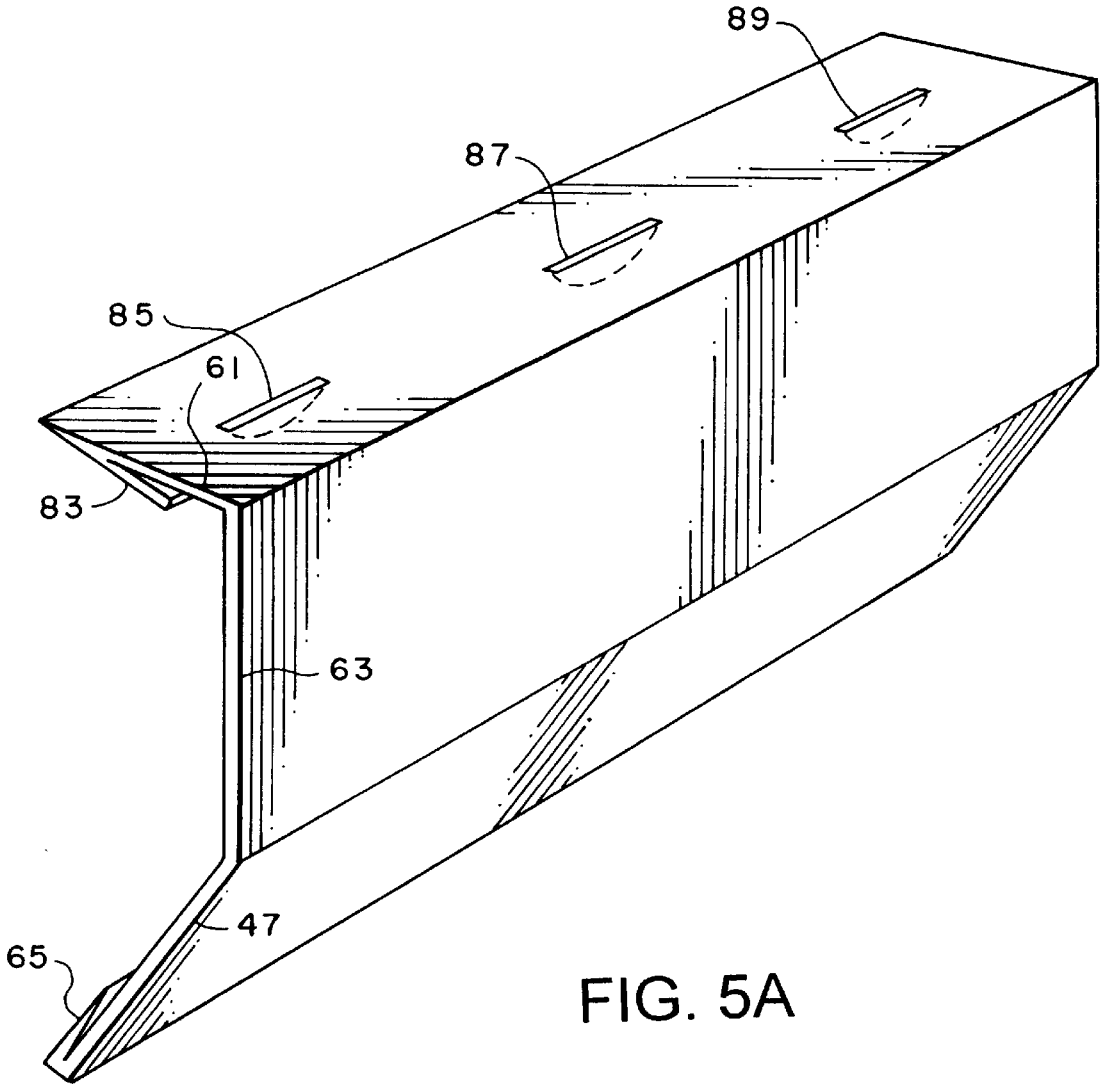
FIGS. 5A and 5B are perspective views illustrating an alternate embodiment of the top panel snap-in trim of the present invention.
Figure 5B:
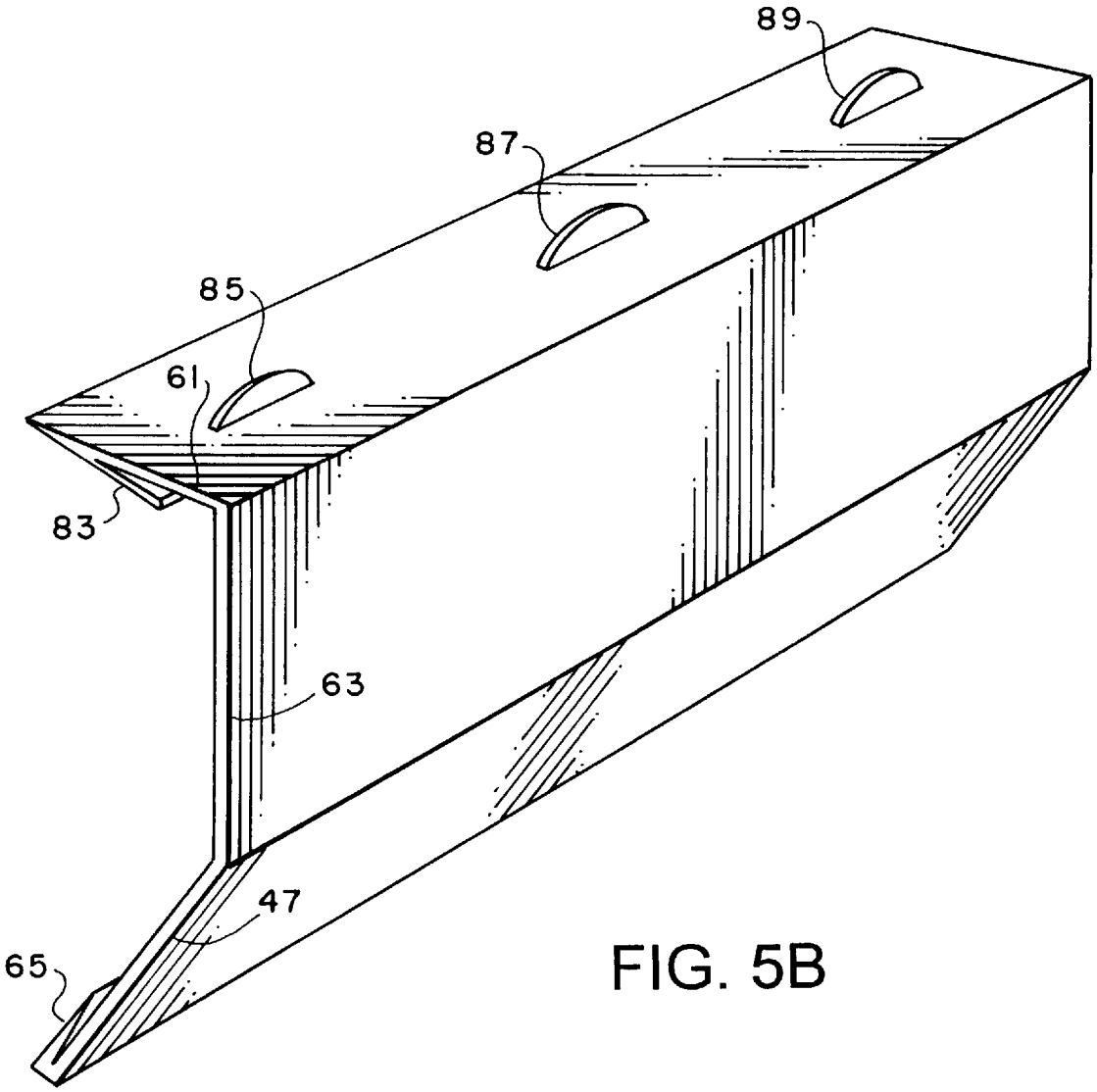

FIGS. 5A and 5B are perspective views illustrating an alternate embodiment of the snap-in trim of the present invention. The snap-in trim 81 includes a snap-in trim fastener 47, a snap-in trim extender 61, a snap-in trim base 63, a snap-in trim stiffener 65, a flattened snap-in trim grasper 83, and crimps 85–89. The snap-in trim 81 is the same as the snap-in trim 43 (depicted in FIGS. 2, 3, and 4) except for two differences. First, the flattened snap-in trim grasper 83 is flattened down against the snap-in trim extender 61, unlike the snap-in trim grasper 45 which forms an acute angle with the snap-in trim extender 61 depicted in FIGS. 2, 3, and 4. In this embodiment, the flattened snap-in trim grasper 83 functions as an additional stiffener. Second, an installer utilizes a crimping tool to put crimps 85–89 along the top or bottom surfaces of snap-in trim extender 61. The crimps 85–89 may be placed where the embossed slots forms ridges on the bottom or top surface of the snap-in trim extender 61. FIG. 5A illustrates the snap-in trim with the crimps formed on the bottom surface of the extender 61, while FIG. 5B illustrates the snap-in trim with the crimps formed on the top surface of the extender 61. The use of crimps allows the snap-in trim to be removed from the J-channel or finish trim bracket, if necessary, without removing any other components of the trim finishing system. Although three crimps are depicted in FIG. 5, a greater or lesser number of crimps may be utilized, depending on the length of the snap-in trim 81.

By flattening down the flattened snap-in trim grasper 83 and placing crimps 85–89 upon the surface of the snap-in trim extender 61, the snap-in trim 81 provides an alternate method of securing the snap-in trim 81 into a J-channel or finish trim bracket.

Figure 6:
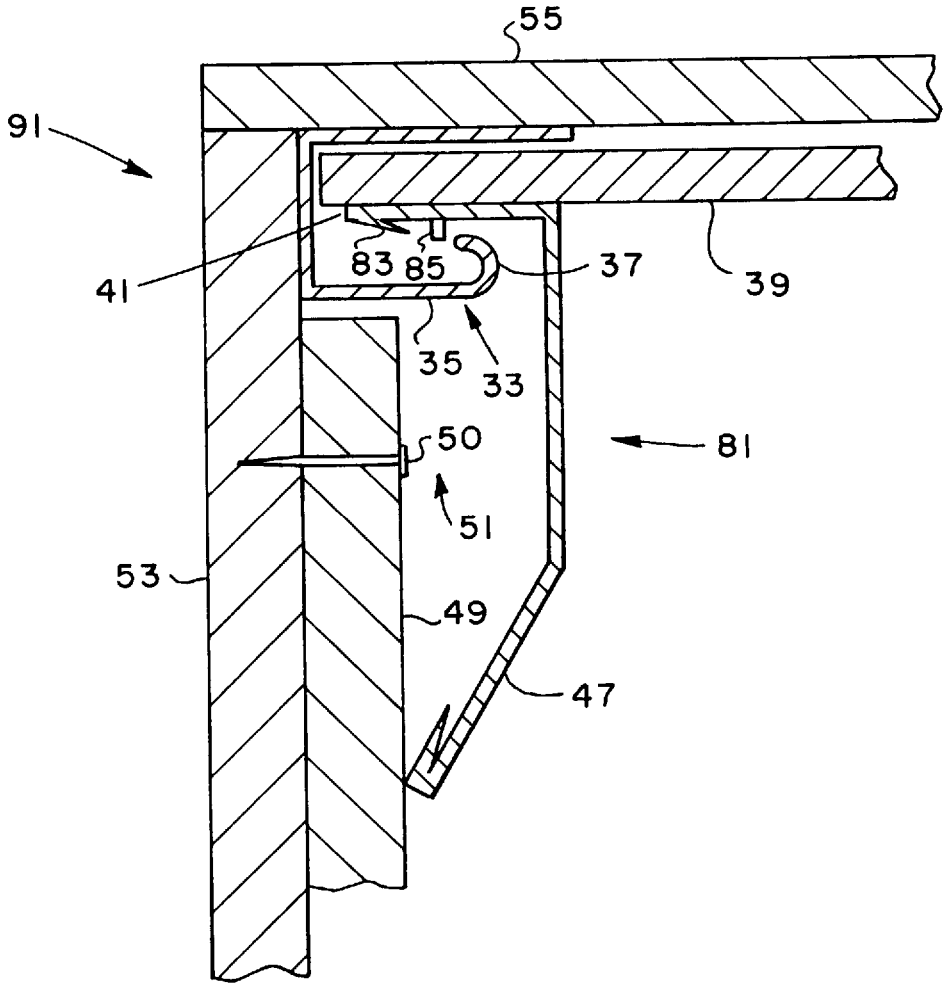
FIG. 6 is a sectional view illustrating a third embodiment of the trim finishing system of the present invention in which the snap-in trim utilizes crimps to secure the top panel snap-in trim to the J-channel bracket.

FIG. 6 is a sectional view illustrating a third embodiment of the trim finsihing system of the present invention utilizing the snap-in trim of FIG. 5A. The trim finishing system 91 includes a soffit panel J-channel bracket 33 having a J-channel clip 35 and a hook 37, a soffit panel 39, a J-channel gap 41, a snap-in trim 81 having a flattened snap-in trim grasper 83, a crimp 85, and a snap-in trim fastener 47, a top panel 49, a nail 50, a top panel gap 51, a side wall 53, and a soffit 55.

The J-channel bracket 33, soffit panel 39 and top panel 49 depicted in FIG. 6 are the same as that depicted in FIG. 2. Referring to FIGS. 5A and 6, the snap-in trim 81 is secured to the J-channel bracket 33 when the crimp 85 on the snap-in trim 81 snaps over the J-channel bracket's hook 37 as the snap-in extender 61 is inserted into the J-channel bracket 33. Although FIG. 6 depicts the crimp 85 forming a ridge on the bottom side of the snap-in extender 61, in other embodiments, the ridge may be formed on the top surface of the snap-in extender 61, depending on the angle and orientation of the J-channel bracket. The snap-in trim system 91 may be used in a variety of areas such as window facing and door facing.

Figure 7:
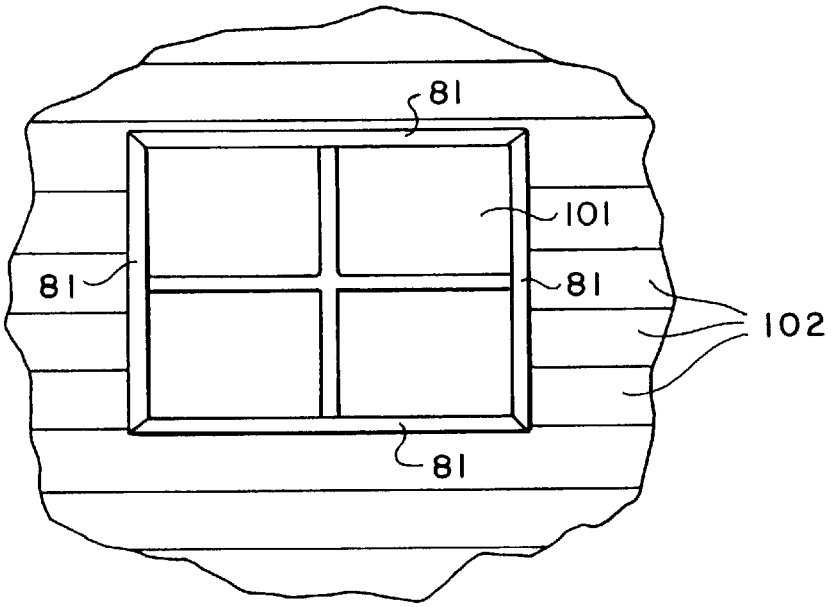
FIG. 7 is a front view of a portion of a wall covered with siding illustrating the top panel snap-in trim of the present invention when utilized as window facing.

FIG. 7 is a front view of a portion of a wall covered with siding illustrating the top panel snap-in trim 81 when utilized as window facing for window 101. The snap-in trim 81 may be utilized to form a border around the window, thereby providing a decorative appearance and eliminating the need for precise cutting of the ends of the siding panels 102 which abut the window.

Figure 8:
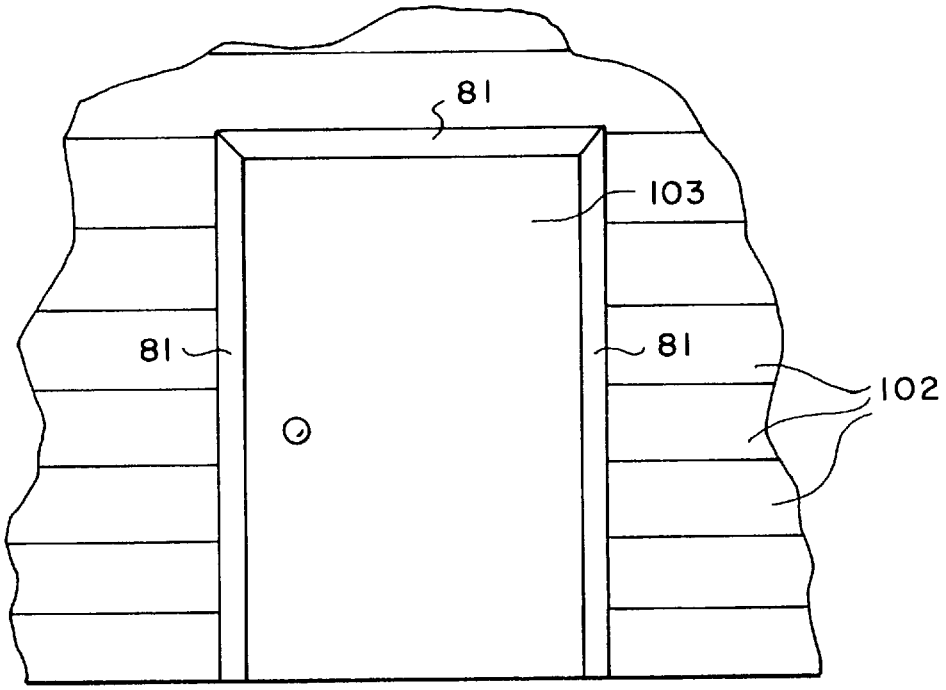
FIG. 8 is a front view of a portion of a wall covered with siding illustrating the top panel snap-in trim of the present invention when utilized as door facing.

FIG. 8 is a front view of a portion of a wall covered with siding illustrating the top panel snap-in trim 81 when utilized as door facing for a door 103. The snap-in trim 81 may be utilized to form a border around the window, thereby providing a decorative appearance and eliminating the need for precise cutting of the ends of the siding panels 102 which abut the window. The snap-in trim 81 may be utilized to form a border around the door, thereby providing a decorative appearance and eliminating the need for precise cutting of the ends of the siding panels 102 which abut the door. Additionally, the trim finishing system 91 may be used as seal trim, edge trim, or top out finish trim for both flat angles or gables.

Figure 9:
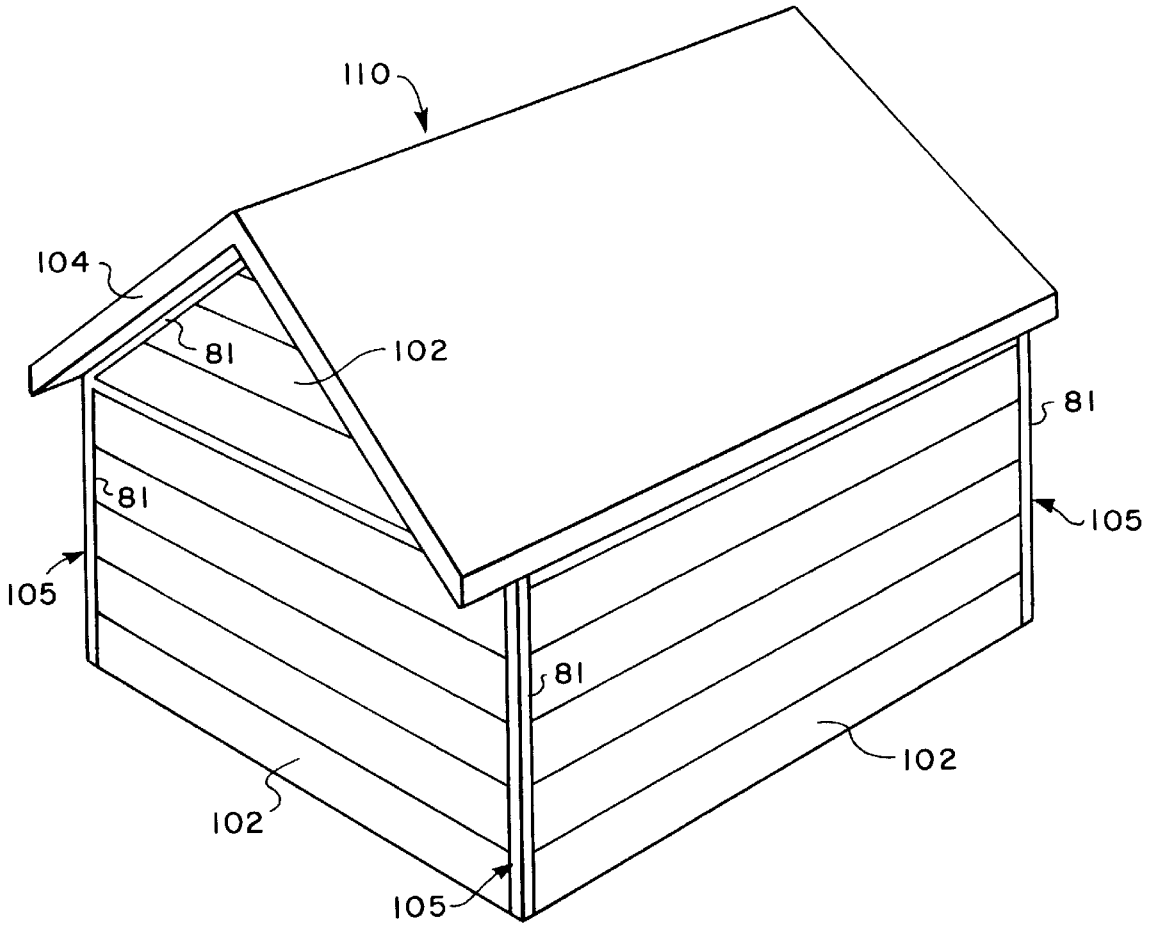
FIG. 9 is a perspective view of a gabled structure 110 covered with siding on which the top panel snap-in trim 81 has been utilized as seal trim and edge trim.

FIG. 9 is a perspective view of a gabled structure covered with siding on which the top panel snap-in trim 81 has been utilized as seal trim and edge trim. In FIG. 9, the snap-in trim is utilized as seal trim under a gable 104. The snap-in trim is utilized as edge trim at the corners 105 of the structure. The snap-in trim forms a border around sections of the structure, thereby providing a decorative appearance and eliminating the need for precise cutting of the ends of the siding panels 102. Crimps provide the advantage in that the snap-in trim 81 may be removed from the J-channel bracket 33 by inserting a screwdriver at the point where the crimp 85 and the hook 37 meet and popping out the snap-in trim 81.

It is thus believed that the operation and construction of the present invention will be apparent from the foregoing description. While the apparatus and system shown and described have been characterized as being preferred, it will be readily apparent that various changes and modifications could be made therein without departing from the spirit and scope of the invention as defined in the following claims.

What is claimed is:

1. A system for finishing and securing an exterior siding top panel, said system comprising:

a wall to which said siding top panel is attached;

an orthogonal surface, said wall meeting said orthogonal surface at a right-angle corner at a top end of said wall;

a siding panel covering said orthogonal surface;

a J-channel bracket mounted on said orthogonal surface at said corner for holding an end of said siding panel covering said orthogonal surface, said J-channel bracket having a J-channel clip with a hook at an end projecting outward from a side facing said siding panel covering said orthogonal surface;

a snap-in trim piece holding a top end of said siding panel, said snap-in trim piece having a plurality of crimps running along a top surface of said snap-in trim piece; and means for interlocking said J-channel bracket and said snap-in trim piece to finish and secure said siding top panel to said wall, said means for interlocking located on a side of said J-channel bracket facing said siding panel covering said orthogonal surface and formed by inserting said plurality of crimps between said siding panel covering said orthogonal surface and said hook in said J-channel clip;

whereby said plurality of crimps and said hook are held in place by said siding panel covering said orthogonal surface.

2. A system for providing finishing trim for exterior siding panels, said system comprising:

a wall to which said exterior siding panel is attached;

an orthogonal surface, said wall meeting said orthogonal surface at a right-angle corner at a top end of said wall;

a bracket mounted on said orthogonal surface at said corner, said bracket including a clip having a hook at an end projecting outward from a side facing said exterior siding panel;

a piece of snap-in trim covering an end of said exterior siding panels, said snap-in trim piece including a snap-in trim extender inserting in said bracket; and at least one crimp forming a ridge on a bottom surface of said snap-in trim extender, said crimp interlocking on a side of said bracket facing said exterior siding panel with said hook at the end of said clip when said snap-in trim extender is inserted in said bracket.

3. The system of claim 2 wherein said bracket is a J-channel bracket.

4. The system of claim 2 wherein said bracket is a finish trim bracket.

5. The system of claim 2, further comprising a siding panel covering said orthogonal surface and wherein said bracket holds an end of said siding panel covering said orthogonal surface.

6. The system of claim 5 wherein said snap-in trim piece contacts said siding panel at a lower end of said snap-in trim piece, thereby assisting in securing said siding panel to said wall.

7. The system of claim 6 wherein said snap-in trim piece and said siding panel form a chamber above said lower end of said snap-in trim piece and below said snap-in trim extender.

8. The system of claim 7 wherein said snap-in trim piece is approximately 3 inches high.

9. The system of claim 2 wherein said snap-in trim piece is constructed of poly-vinyl chloride (PVC) coated aluminum.

10. The system of claim 2 wherein said snap-in trim piece is constructed of vinyl.

11. The system of claim 2 wherein said snap-in trim piece is window facing.

12. The system of claim 2 wherein said snap-in trim piece is door facing.

13. The system of claim 2 wherein said snap-in trim piece is seal trim.

14. The system of claim 2 wherein said snap-in trim piece is edge trim.

15. A method of providing finishing trim for exterior siding on a wall, said wall meeting an orthogonal surface at a right-angle corner, said method comprising the steps of:

covering said orthogonal surface with a siding panel;

mounting a J-channel bracket on said orthogonal surface for holding an end of said siding panel covering said surface, said J-channel bracket including a J-channel clip having a hook at an end projecting out from a side facing said siding panel covering said orthogonal surface;

attaching said siding panel to said wall;

interlocking, on a side of said J-channel bracket facing said siding panel covering said orthogonal surface, a snap-in trim piece having an extender on an end thereof with a crimp forming a ridge on a surface of said snap-in trim piece and said J-channel hook, whereby said grasper and said hook are held in place by said siding panel covering said orthogonal surface; and contacting said siding panel at a lower end of said panel snap-in trim piece, thereby securing said siding top panel to said wall.

16. The method of claim 15 wherein said step of attaching said siding panel to said wall includes the step of nailing said siding panel to said wall.

17. The method of claim 16 wherein said step of attaching said siding panel to said wall includes the step of riveting said siding panel to said wall.

18. A combination comprising:

a J-channel bracket;

a generally horizontal soffit panel having a back edge portion mounted in the J-channel bracket;

a generally vertical siding top panel having a top edge flush with a bottom edge of the J-channel bracket; and a top panel snap-in trim for securing the siding top panel and concealing the J-channel bracket, said top panel snap-in trim comprising:

a plurality of crimps running along a top surface of said top panel snap-in trim, the plurality of crimps being pressed horizontally between a bottom face of the soffit panel and the J-channel bracket to hold the top panel snap-in trim bracket in place;

a substantially vertical snap-in trim base connected to the extender at an outside end, said trim base extending downward from the soffit panel and concealing the J-channel bracket from view; and a snap-in trim fastener connected to the snap-in trim base at an angle sloping toward the generally vertical siding top panel, said trim fastener contacting the generally vertical siding top panel below the J-channel bracket and securing the top panel.

19. The combination of claim 18 wherein said top panel snap-in trim and said siding top panel form a chamber above said snap-in trim fastener and below said top panel snap-in trim extender.

* * * * *